US009126348B2

(12) United States Patent
Meyer et al.

(10) Patent No.: US 9,126,348 B2
(45) Date of Patent: Sep. 8, 2015

(54) METHOD FOR REGULATING THE SPEED OF A CUTTING DEVICE

(75) Inventors: Hanspeter Meyer, Huettwilen (CH); Thomas Kruegel, Seuzach (CH)

(73) Assignee: MUELLER MARTINI HOLDING AG, Hergiswil (CH)

( * ) Notice: Subject to any disclaimer, the term of this patent is extended or adjusted under 35 U.S.C. 154(b) by 302 days.

(21) Appl. No.: 13/584,851

(22) Filed: Aug. 14, 2012

(65) Prior Publication Data

US 2013/0042734 A1 Feb. 21, 2013

(30) Foreign Application Priority Data

Aug. 15, 2011 (CH) ..... 1338/11

(51) Int. Cl.

| | |
|---|---|
| ***B26D 5/32*** | (2006.01) |
| ***B26D 5/20*** | (2006.01) |
| ***B26D 7/06*** | (2006.01) |
| ***B65H 31/30*** | (2006.01) |
| ***B65H 31/02*** | (2006.01) |
| ***B65H 31/32*** | (2006.01) |
| ***B65H 33/00*** | (2006.01) |

(52) U.S. Cl.

CPC .. *B26D 5/32* (2013.01); *B26D 5/20* (2013.01); *B26D 7/0675* (2013.01); *B65H 31/02* (2013.01); *B65H 31/3018* (2013.01); *B65H 31/3027* (2013.01); *B65H 31/3081* (2013.01); *B65H 31/32* (2013.01); *B65H 33/00* (2013.01); *B65H 2301/4212* (2013.01); *B65H 2301/4229* (2013.01); *B65H 2511/51* (2013.01); *B65H 2513/50* (2013.01); *B65H 2557/242* (2013.01); *B65H 2701/1932* (2013.01); *Y10T 83/0476* (2015.04)

(58) Field of Classification Search

CPC ..... B26D 5/20; B26D 5/28; B26D 5/32; B26D 7/0675

USPC ..... 83/361, 364, 365, 367, 370, 934, 403.1, 83/110, 90–96, 29, 13, 72, 75, 76, 76.8, 83/211; 27/58.07; 198/341.01, 341.07, 198/571, 572, 573, 341.08, 341.03

See application file for complete search history.

(56) References Cited

U.S. PATENT DOCUMENTS

| | | | | |
|---|---|---|---|---|
| 3,207,017 | A * | 9/1965 | McCain | 83/27 |
| 3,693,486 | A * | 9/1972 | Maniaci et al. | 83/88 |
| 3,841,182 | A * | 10/1974 | Cosgrove et al. | 83/89 |

(Continued)

FOREIGN PATENT DOCUMENTS

| | | |
|---|---|---|
| DE | 3302946 C2 | 12/1986 |
| DE | 3920557 A1 | 1/1991 |

(Continued)

*Primary Examiner* — Ned Landrum
*Assistant Examiner* — Richard Crosby, Jr.
(74) *Attorney, Agent, or Firm* — Leydig, Voit & Mayer, Ltd.

(57) ABSTRACT

A method for regulating a speed of a cutting device comprising a cutter for cutting printed products includes transporting the printed products consecutively on a first conveying component of a feed device. A final printed product of a stack of the printed products to be formed is detected. The stack is formed in a stacking device. The stack is transported to the cutter using the feed device. An actual number of cycles of the cutter is regulated based on a time of the detecting the final printed product of the stack such that the stack is fed to the cutter within a time window.

7 Claims, 5 Drawing Sheets

(56) References Cited

U.S. PATENT DOCUMENTS

| | | | | |
|---|---|---|---|---|
| 4,505,173 | A | 3/1985 | Hartlage | |
| 4,545,447 | A * | 10/1985 | Spooner et al. | 177/165 |
| 5,014,582 | A * | 5/1991 | Teik | 83/24 |
| 6,286,292 | B1 * | 9/2001 | Spatafora et al. | 53/492 |
| 7,125,216 | B2 | 10/2006 | Grewe et al. | |
| 2005/0098934 | A1 * | 5/2005 | Denny | 270/1.01 |
| 2006/0081100 | A1 * | 4/2006 | Fassbind | 83/13 |
| 2007/0035080 | A1 * | 2/2007 | Yamada et al. | 270/58.07 |
| 2012/0257946 | A1 * | 10/2012 | Mueller | 412/1 |
| 2012/0292156 | A1 * | 11/2012 | Buerge | 198/460.3 |

FOREIGN PATENT DOCUMENTS

| | | | |
|---|---|---|---|
| DE | 10321370 | A1 | 12/2004 |
| EP | 0887157 | A2 | 12/1998 |

* cited by examiner

METHOD FOR REGULATING THE SPEED OF A CUTTING DEVICE

Priority is claimed to Swiss Patent Application No. CH 01338/11, filed on Aug. 15, 2011, the entire disclosure of which is hereby incorporated by reference herein.

FIELD

The invention relates to a method for regulating the speed of a cutting device, the cutting device comprising a cutter for cutting printed products and a feed device for feeding printed products to the cutter, stacks of printed products being formed from the printed products in a stacking device prior to cutting and the printed products for a stack to be formed being transported consecutively on a first conveying component of the feed device.

BACKGROUND

After binding, roughly bound printed products such as books, paperbacks, newspapers or similar products are cut to their finished dimensions on the three unbound edges. When such products are manufactured industrially, the machines required for the entire production process are usually linked in series. In this process, printed sheets are first transferred to a gathering machine and gathered by this machine to form loose book blocks. The loose book blocks are then transferred to a binding machine in which the book blocks are bound at the spine and the bound printed products are transported by conveyor belts, on which the process of curing the adhesive used in binding takes place, to a cutting device. Further machines, such as stackers, film wrapping machines and strapping machines may be located downstream of the cutting device.

Even if the speeds of the machines and conveying means can be coordinated, irregular feeds often arise, especially on the conveyor belts between the binding machine and the cutting device, because defective printed products are extracted, specimen copies are removed and returned again by operating staff or printed products become jammed in the event of deflections, for example. This leads to an irregular supply of printed products to the cutting device in particular.

A cutting device of this type with a triple cutter is disclosed in DE3302946 C2 for example. However, such devices have the disadvantage that the number of cycles which can be achieved is significantly lower than the maximum number of cycles which can be achieved by the other machines. However, this disadvantage can be offset by feeding printed products to the cutter of the cutting device cutter in stacks. During this process, the height of the stack to be cut or the number of printed products per stack is produced by what is known as a feeder located upstream of the cutter and the stack is fed to the cutter via this feeder. The feeder comprises a hopper in which the printed products supplied by the binding machine are stacked and a pushing system which pushes stacks with a defined height or a defined number of printed products from out of the bottom of the hopper and transfers them to the cutter. To prevent overfilling of the hopper, the number of cycles of the triple cutter is set slightly higher than is required by the average performance of the binding machine. This means that the filling level in the hopper constantly reduces.

To prevent the hopper from running out of printed products, the hopper filling level is monitored. The pushing process is interrupted at a minimum admissible filling level and the cutter performs one or more empty cycles until an adequate filling level is reached once more. Alternatively, the cutting device can be stopped instead of performing empty cycles. Such devices have been tried and tested when processing thick printed products. However, in the case of thin printed products, separating the printed products exactly into stacks is an imprecise process, which can lead to errors and machine downtime.

To avoid this problem, a precisely counted stack is formed in the hopper in a further cutting device embodiment and this is subsequently pushed into the cutter. During the pushing process, the supply of additional printed products must be interrupted. An accumulating conveyor can be provided for this purpose upstream of the cutting device hopper. In this type of device the number of cycles of the cutter can also be set slightly higher than the average number of cycles required to avoid overfilling the accumulating conveyor. In this process, empty cycles can be generated from time to time or the cutter can be stopped. The counting process makes it possible to achieve precise stacks even with thin printed products. However, the associated disadvantage is the restricted performance caused by the accumulating conveyor. In other words, after accumulating, the printed products cannot be accelerated fast enough even by using a suction belt. A further disadvantage is that the accumulating conveyor may leave pressure marks on printed products with sensitive surfaces.

DE3920557 C2 proposes regulating the number of cycles of the cutting device automatically as a function of the printed products fed to the stacking hopper of the cutting device per unit of time. Despite the irregular product flow, this is intended to permit substantially trouble-free operation of the cutting device. This method admittedly minimises the number of empty cycles, but cannot avoid them completely. The method is suited to cutting devices which are loaded at relatively low speeds. If products are supplied rapidly, jams may arise when loading is resumed after interrupting the product supply, because the cutting device has only a relatively low acceleration from standstill to production speed.

Using a loading device as shown in EP0887157 should make it possible to load a cutting device which guarantees a selection of different numbers of cut products even with a non-continuous and extremely rapid succession of supplied printed products. To this end, the loading device has a counting hopper with two stacking shelves positioned one on top of the other, these being automatically controlled by the supply and removal of printed products. A pusher positioned beneath the counting hopper enables complete stacks of printed products to be fed to the cutting section in synchronisation. The control system uses signals from sensors positioned on the hopper to detect book blocks, the first sensor being positioned directly in front of the hopper, the second sensor being located on the lower stacking shelves and the third sensor being positioned on the feed table. The counting hopper can be operated in different operating modes depending on the number of copies per stack.

DE10321370 also describes a cutting device with a counting hopper, a shingled stream separator being positioned upstream of this hopper. This should make it possible to reliably process thin products which are supplied in a shingled stream.

SUMMARY

In an embodiment, the present invention provides a method for regulating a speed of a cutting device comprising a cutter for cutting printed products. The printed products are consecutively transported on a first conveying component of a feed device. A final printed product of a stack of the printed products to be formed is detected. The stack is formed in a stacking device. The stack is transported to the cutter using the feed device. An actual number of cycles of the cutter is regulated based on a time of the detecting the final printed product of the stack such that the stack is fed to the cutter within a time window.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

In an embodiment, the invention regulates the speed of a cutting device in such a way that the buffer capacity of the stacking hopper is always sufficient, even with an irregular supply of printed products, to avoid the hopper overfilling. In addition, the surfaces of the printed products are handled with care.

In an embodiment, the invention provides a method for regulating the speed of a cutting device in which the printed products in each stack to be formed are detected and an actual number of cycles of the cutter is regulated on the basis of the time of detecting a final printed product of each stack to be formed such that the stack is fed to the cutter within a time window.

The stack formed is preferably transported to the cutter on a second conveying component of the feed device. In this process, the time window is calculated as the difference between the longest time available and the shortest time available to feed the stack thus formed to the second conveying component.

In a preferred embodiment of the invention, the stack formed is transported to the cutter by means of a pusher on the second conveying component, a minimum and a maximum value for an offset time being calculated from the calculated time window and the stack being transported to the cutter on expiry of the offset time. The fact that the actual number of cycles of the cutter is calculated and adjusted accordingly makes it possible to ensure that the cutter is adjusted as continuously as possible to the speed of the supplied printed products.

In a preferred embodiment of the invention, the actual number of cycles of the cutter is regulated on the basis of the arrival time of the final printed product of a stack to be formed. In this process, the actual number of cycles of the cutter can be regulated by reducing or increasing this actual number of cycles compared with a previous number of cycles. If the final printed product of a stack to be formed is supplied very late, at least one empty cycle of the cutter is preferably inserted and the actual number of cycles of the cutter is increased.

In the preferred embodiment of the invention, the speed of the printed products on the first conveying component of the feed device is adjusted as a function of the length of the printed products and irrespective of the actual number of cycles of the cutter. In this process, printed products may be fed to the cutting device from a processing machine located upstream of the cutting device, a nominal number of cycles for the cutter of the cutting device being preset by the processing machine.

Figure 1:
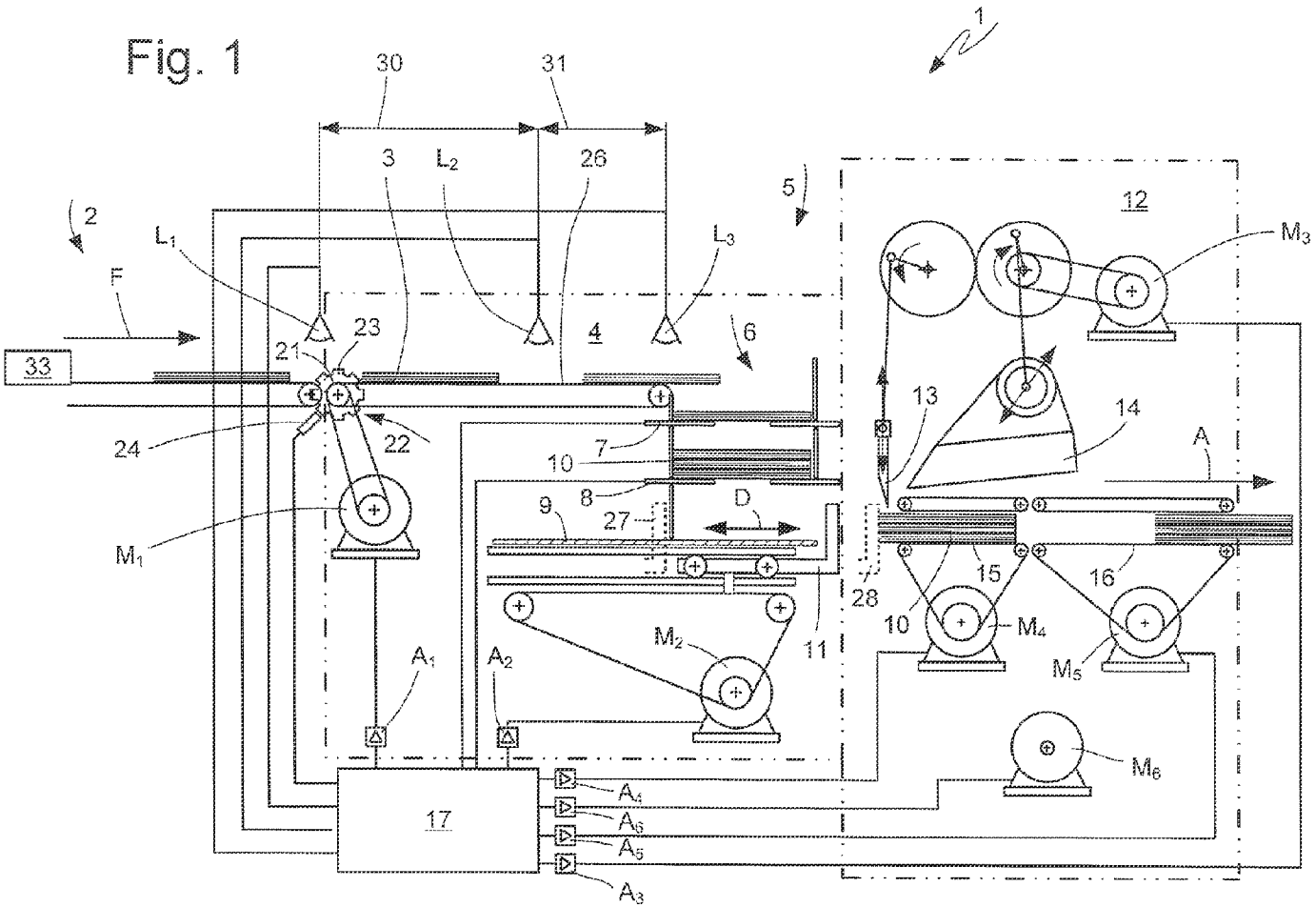
FIG. 1 is a schematic representation of a cutting device for three-sided cutting of printed products according to an embodiment of the invention.

FIG. 1 shows a cutting device 1, to which printed products 3 are fed by way of a conveying means 2 in a feed direction F from a processing machine 33, e.g. a binding machine for producing printed products, a destacking device or a feeder, for example, this being located upstream of the cutting device. In this process, the printed products 3 do not have to be fed directly from the processing machine 33, but can be stored on an interim basis for example, before feeding to the cutting device 1. The printed products 3 are cut to their finished dimensions on the three open side edges by the cutting device 1. In the simplest case, the conveying means 2 located between the processing machine 33 and the cutting device 1 is formed by consecutive conveyor belts on which the printed products 3 are conveyed individually and one after the other. The conveying means 2 may comprise additional devices, such as, for example, shingling and deshingling devices, diverter and distribution gates, direction devices and curved components, especially in facilities with a high production output.

The conveying means 2 feeds the printed products 3 individually, one after the other, to a feed device 4 of the cutting device 1, which comprises an initial conveying component 26 designed as a conveyor belt in this case, which can be driven by means of an adjustable motor $M_1$. The speed of the conveying means 2 located upstream of the first conveying component 26 is selected as a function of the length of the printed products 3 and the number of cycles of the processing machine 33 such that the gaps between consecutive printed products 3 on the conveying means 2 are as small as possible. The upper frequency of the supplied printed products 3 is thus limited. In order to ensure that gaps are formed between consecutive printed products 3 for visual detection purposes, for example, the speed of the first conveying component 26 is always higher than the speed of the conveying means 2.

The printed products 3 are fed to a stacking device 5 by means of the first conveying component 26, this stacking device being made up of a vertical stacking shaft 6 with upper stack pushers 7 and lower stack pushers 8 arranged on two levels. The stack pushers 7, 8 which are arranged in pairs can be moved in the direction of a double arrow D between a closed position, in which the printed products 3 are held back, and an open position, in which the printed products 3 are released. To avoid pressure marks on the lowermost printed product 3, the stack pushers 7, 8 are also accelerated vertically downwards when opening. The printed products 3 can be buffered for a certain time by the stacking device 5. The stacking shaft 6 is limited at its lower end by a second conveying component 9 in the form of a feed table onto which stacks 10 formed from a number of printed products 3 are fed from above by the stacking device 5.

The stacks 10 are conveyed on the second conveying component 9 by means of a pusher 11 which can also be moved forwards and backwards in the direction of the double arrow D to a cutting table of a cutter 12 of the cutting device 1. The stack 10 is then tensioned between the cutting table and a pressure plate. In this position, the stack 10 is cut at the front edge by means of a front blade 13 and at both side edges by means of side blades 14, although the cutting sequence can also be reversed. After releasing the pressure plate, the cut stack 10 is removed in a removal direction A by a first conveyor 15 and a subsequent second conveyor 16. The cutting table is then free to accept the next stack 10 to be cut.

The pusher 11 is preferably driven by a motor $M_2$, front blade 13 and side blades 14 are driven jointly by a motor $M_3$, the first conveyor 15 is driven by a motor $M_4$ and the second conveyor 16 is driven by a motor $M_5$. An additional motor $M_6$ forms a main drive for the cutting device 1. The main drive drives all the components of the cutting device 1 not already mentioned, such as alignment components on the cutting table, transfer devices, etc., and forms the master drive for motors $M_{1 \ldots 5}$.

Motors $M_{1 \ldots 6}$ are designed as motors with rotational angle control which are connected to corresponding drive controllers $A_{1 \ldots 6}$. The drive controllers $A_{1 \ldots 6}$ are connected to a control device 17 to exchange control signals. Alternatively, the drive controllers $A_{1 \ldots 6}$ can be designed as part of the control device 17. Output terminals of the control device 17 are connected to actuating devices for the upper stack pushers 7 and the lower stack pushers 8 and input terminals of the control device 17 are connected to light barriers $L_{1 \ldots 3}$ and a sensor 24.

The light barrier $L_1$ is located at the beginning and light barrier $L_3$ is located at the end of the first conveying component 26. The light barrier $L_2$ is located downstream of the light barrier $L_1$, the distance 30 between these two light barriers $L_1$, $L_2$ corresponding to at least the length of a printed product 3 in the feed direction F.

The method is explained in detail below with reference to FIGS. 2 to 5. The following examples all relate to cutting printed products 3 in stacks of three copies. However, they are universally applicable, a stack 10 being formed by at least one printed product 3. The processing machine 33 produces with a defined number of cycles T, resulting in a nominal number of cycles $T_N$ from one third of the number of cycles T of the processing machine 33 and a cycle time $t_Z$ for the cutting device 1. In continuous operation, printed products 3 to be cut are also fed continuously via the conveying means 2 to the feed device 4 of the cutting device 1.

Figure 2:
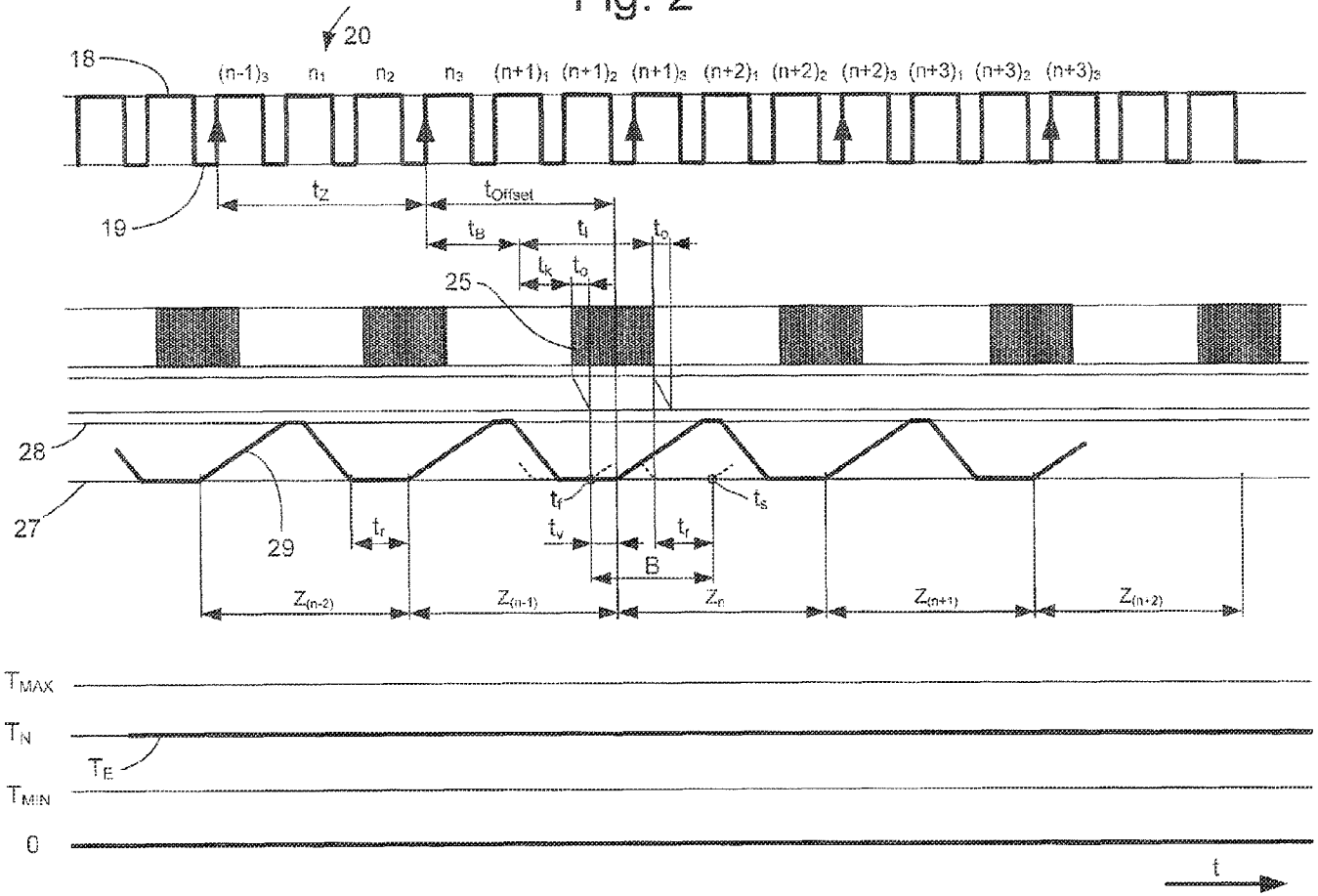
FIG. 2 is a diagram showing the time sequences for continuous product feed.

The light beam of light barrier $L_2$ is interrupted cyclically by the transported printed products 3. This results in a signal with dark phases 18 when the light beam is interrupted and light phases 19 when there are no printed products 3 in the vicinity of the light beam. A corresponding time diagram is shown at the top of FIG. 2, in which impulses 20 formed from one dark phase 18 and one light phase 19 in each case correspond to consecutively numbered printed products 3 of each stack 10 to be formed. The details in brackets refer to the number of a stack 10 and the subscript number refers to a number of the printed product 3 in the stack 10. The impulse 20 with number $(n-1)_2$ is thus assigned to the printed product 3 with number two in the stack 10 with number (n+1).

By incorporating the number of printed products 3 per stack 10 and the time between consecutive impulses 20, the control device 17 calculates an associated actual number of cycles $T_E$ or a machine cycle $Z_n$ of the cutting device 1 and drives the motor $M_6$ by means of the drive controller $A_6$ at the corresponding speed. With impulses 20 generated continuously by the $L_2$ light barrier, this results in similarly continuous operation of the cutting device 1 with an actual number of cycles $T_E$ which corresponds to the nominal number of cycles $T_N$. The actual upper number of cycles $T_E$ is limited by a maximum number of cycles $T_{MAX}$ and the lower number of cycles is limited by a minimum number of cycles $T_{MIN}$.

The speed of the first conveying component 26 of the feed device 4 is calculated by the control device 17 on the basis of the length of the printed products 3 in the feed direction F, which is known to the control device 17, and the motor $M_1$ is driven by the drive controller $A_l$ at the necessary speed, the lower speed of the first conveying component 26 being limited. On the one hand, this ensures that the gaps formed between the printed products 3 in the feed device 4 are large enough and, on the other hand, it ensures that the printed products 3 are fed (by dropping) into the stacking device 5 at not less than a minimum speed. A clock generator 22 is provided on a drive wheel 21 of the first conveying component 26, as shown in FIG. 1, to track the printed products 3 within the feed device 4, this clock generator comprising a toothed wheel 23 and the sensor 24 connected to the control device 17. Alternatively, an integral rotary encoder in motor $M_1$ may be used for this purpose.

By detecting the printed products 3 with the light barrier $L_2$ and product tracking, the control device 17 is constantly able to calculate the position of a printed product 3 on the first conveying component 26 in relation to the light barrier $L_2$ and a time $t_B$ required by a printed product 3 to cover a distance 31 between the light barrier $L_2$ and the light barrier $L_3$, or the time until the printed product 3 is due to arrive at the stacking shaft 6. The control device 17 can also calculate the minimum time required $t_k$ after the light barrier $L_3$ detects a final printed product 3 of the stack to be formed for a finished stack 10 to be formed on the lower stack pushers 8 and a maximum time $t_l$ available before the lower stack pushers 8 must be opened so that they can be ready again in sufficient time to form the next stack 10. Within a time window 25 formed by time $t_l$ and time $t_k$, the lower stack pushers 8 must be opened and the stack 10 thus fed from above onto the second conveying component 9.

On the other hand, the pusher 11 must be in a rear end position 27 when the lower stack pushers 8 are opened and may only commence its forward motion when the stack 10 is positioned on the second conveying component 9. The motion sequence 29 of the pusher 11 is illustrated in FIGS. 2 to 5, the pusher 11 being able to move between its rear end position 27, onto which a stack 10 can be fed from above, and a front end position 28, in which the stack has been completely conveyed onto the cutting table. In its rear end position 27, the pusher 11 is idle during a resting period $t_r$, this resting period $t_r$ corresponding to a constant portion of a machine cycle $Z_n$.

The earliest possible time $t_f$ at which the pusher 11 can start to push is when the stack 10 is fed from above at time $t_k$ and reaches the second conveying component 9 directly after a dropping time $t_o$. The latest possible time $t_s$ at which the pusher 11 can start to push is when the stack 10 is fed from above at time $t_l$, the pusher 11 has simultaneously reached its rear end position 27 and after the resting period $t_r$ during which the pusher 11 remains in the rear end position 27.

A range B, in which the pusher 11 can start to push a stack 10, can thus be calculated using the formula $B=t_l-t_k+t_r-t_o$. Whenever the final printed product 3 in each stack 10 to be formed passes through the light barrier $L_2$, the control device 17 calculates an offset time $t_{Offset}=t_B+t_k+t_o+t_v$ until the start of the pushing motion of the pusher 11 ($t_v$ being a preferential time to be selected, see below) and adjusts the actual number of cycles $T_E$ or the machine cycle $Z_n$ of the cutter 12 such that the pushing motion can start precisely after the offset time $t_{Offset}$. It is advantageous if the time $t_v$ is selected to be more or less equal to B/2 so as to be able to respond to both short-term increases or reductions in the feed speeds for printed products 3.

Whenever the final printed product 3 of a stack 10 to be formed passes through the light barrier $L_3$, the control device 17 compares the calculated time $t_B$ with a measured time and adjusts the actual number of cycles $T_E$ of the cutter 12 in the event of any deviation such that the pushing motion is able to start at the intended point within range B. By measuring the arrival time of the printed products 3 at the stacking shaft 6, it is also possible to control the timing of the stack pushers 7, 8 more accurately.

The sequence is described using the stack 10, comprising three printed products 3 with numbers $n_1$, $n_2$, $n_3$. Printed products 3 with numbers $n_1$ and $n_2$ are detected by the light barrier $L_2$ and generate impulses 20 ($n_1$) and 20 ($n_2$). When the front edge of the printed product 3 with number $n_3$ reaches the light barrier $L_2$, times $t_1$, $t_k$, $t_o$, t, $t_r$ and $t_B$ are calculated. The control device 17 then uses these to calculate the offset time $t_{Offset}$. Some of the values for times $t_l$, t $t_k$, $t_o$, $t_v$, $t_r$ and $t_B$ can alternatively be stored as constants in a memory of the control device 17 and read out from here. The value for $t_o$ may, for example, be classified as a constant if the dropping time $t_o$ for a stack 10 always has the same value in the same stacking device 5 due to design constraints.

If the calculation reveals that, when the cutter 12 of the cutting device 1 is once again operating with the current actual number of cycles $T_E$, after expiry of time $t_{Offset}$, the pusher 11 can start pushing, the actual number of cycles $T_E$ remains constant. Otherwise, the actual number of cycles $T_E$ is adjusted as explained in further detail in the rest of the description.

Figure 3:
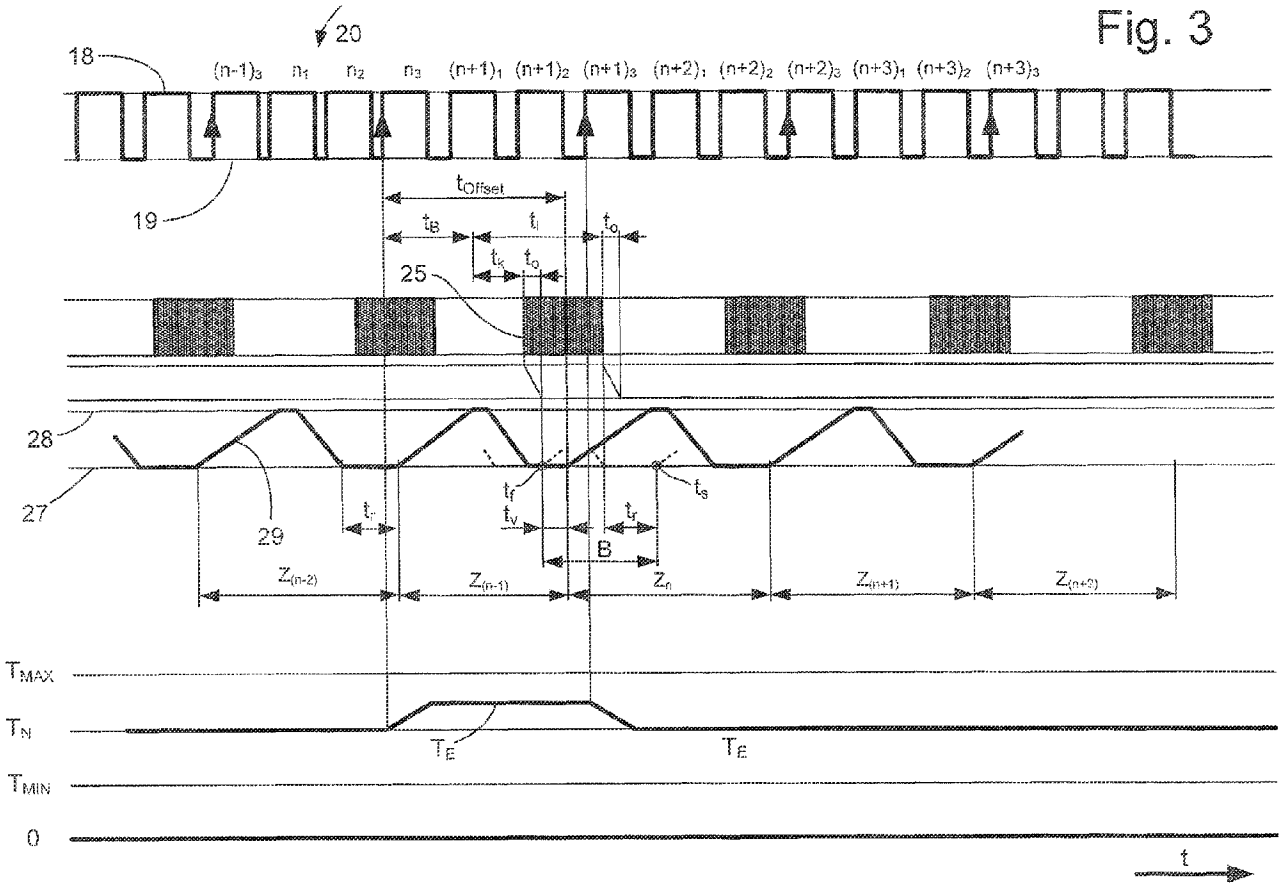
FIG. 3 is a diagram showing the time sequences with increased product feed.

FIG. 3 shows a case in which the three printed products 3 with numbers $n_{1 \ldots 3}$ arrive with an increased frequency and thus the third or final printed product 3 with number $n_3$ of the stack 10 to be formed, bearing number n, arrives earlier than in a previous machine cycle $Z_{(n-2)}$. The actual number of cycles $T_E$ is increased by means of the control device 17 such that the pusher 11 is then ready to push the next stack 10 with number n after expiry of time $t_{Offset}$ in synchronisation. This causes the machine cycle $Z(_{n-1})$ for stack 10 with number (n−1) to be shorter than machine cycle $Z_{(n-2)}$.

Figure 4:
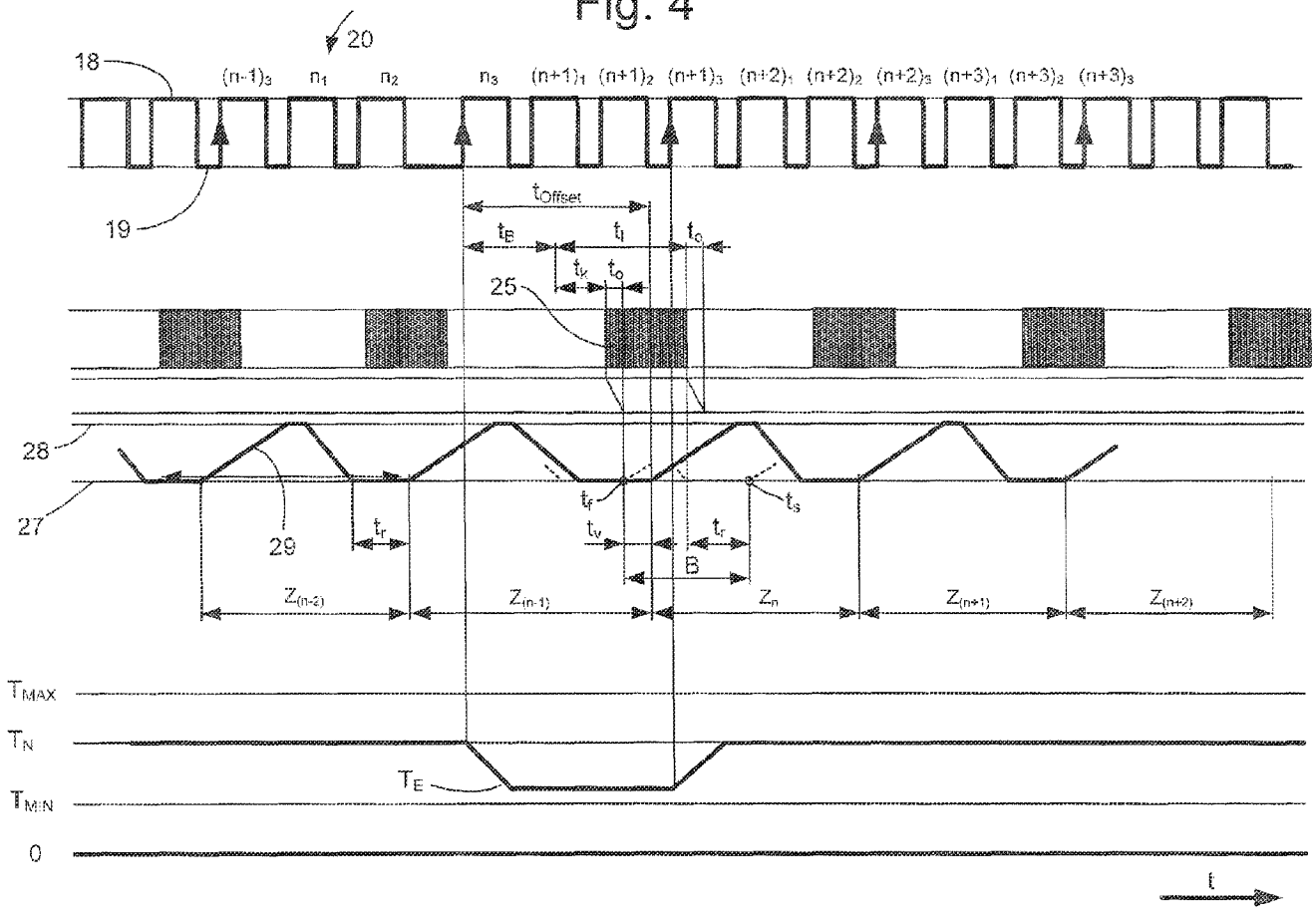
FIG. 4 is a diagram showing the time sequences with reduced product feed and FIG. 5 is a diagram showing the time sequences for very reduced product feed.

FIG. 4 shows a case in which the three printed products 3 with numbers $n_{1 \ldots 3}$ arrive with a reduced frequency and thus the third or final printed product 3 with number $n_3$ of the stack 10 to be formed, bearing number n, arrives later than in the previous machine cycle $Z_{(n-2}$ ). The actual number of cycles $T_E$ is reduced by means of the control device 17 such that the pusher 11 is then ready in sufficient time to push the next stack 10 with number n after expiry of time $t_{Offset}$ in synchronisation. This causes the machine cycle $Z_{(n-1)}$ for stack 10 with number (n−1) to be longer than machine cycle $Z_{(n-2)}$. If it is not possible to compensate for the excessively early or late arrival time of the final printed product 3 in a stack 10 to be formed by increasing or reducing the actual number of cycles $T_E$, the cutter 12 is driven with an increased or reduced actual number of cycles $T_E$ for the duration of several machine cycles. When processing stacks 10 which have a large number of printed products 3, it is conceivable that the printed products 3 preceding the final printed product 3 in a stack 10 to be formed should be detected by the light barrier $L_2$ and the actual number of cycles $T_E$ should be detected merely by evaluating this signal.

Figure 5:
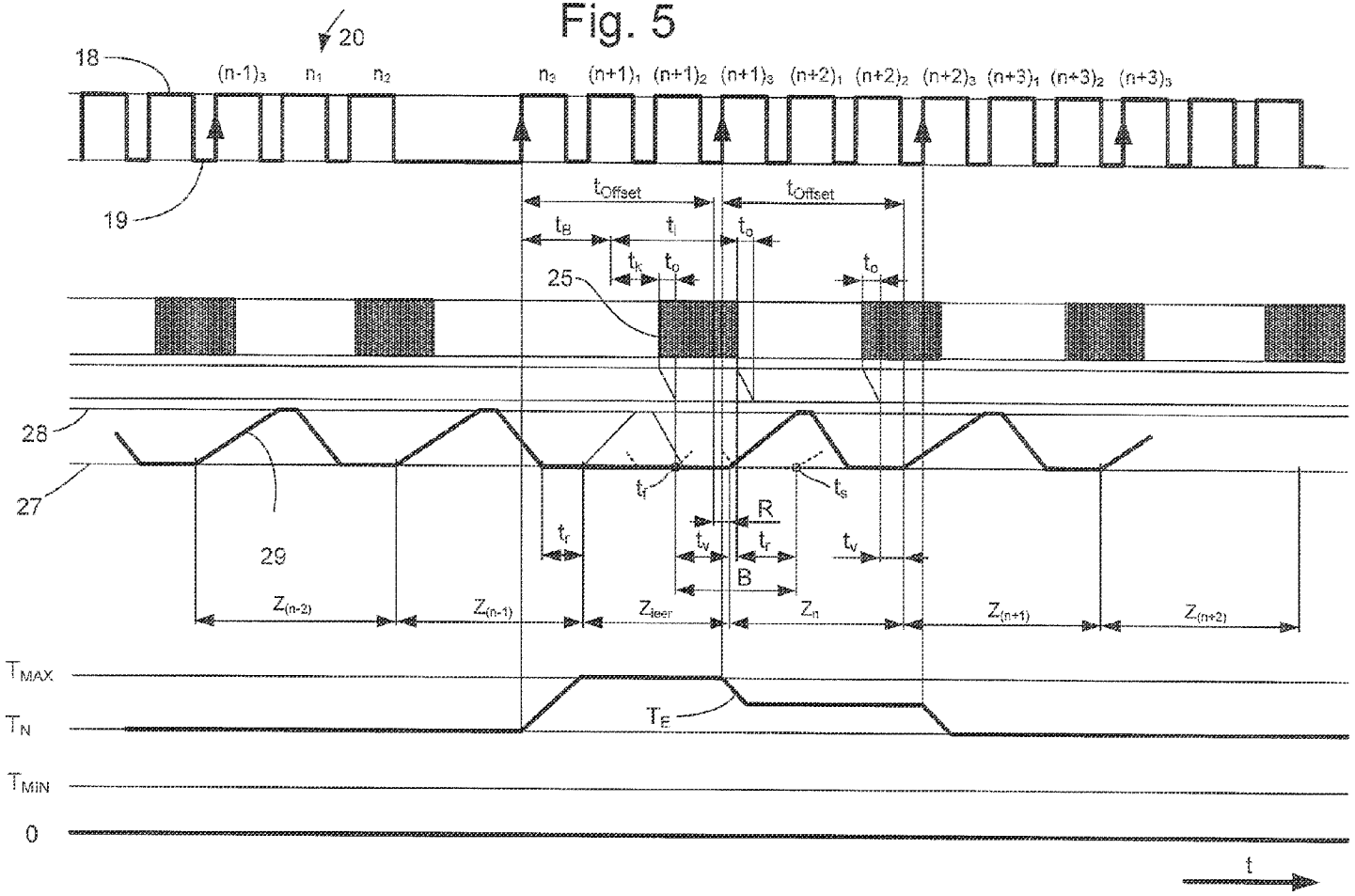

FIG. 5 shows a case in which the third or final printed product 3 with number $n_3$ of the stack 10 is detected by the light barrier $L_2$ at such a late stage that the calculated actual number of cycles $T_E$ would have to be lower than the minimum number of cycles $T_{MIN}$, which is not possible. In this case, the actual number of cycles $T_E$ is increased and the pusher 11 is held back in its rear end position 27 for at least one machine cycle Z, causing the cutter 12 to perform at least one empty cycle in a machine cycle $Z_{empty}$. During an empty cycle, the pusher 11 remains in its rear end position 27 and the motor $M_3$ used to drive the front blade 13 and the side blades 14 is then stopped for the duration of a machine cycle. If there are no more printed products 3 inside the cutter 12 after a number of consecutive empty cycles, all the drives of the cutter 12 can be stopped. The actual number of cycles $T_E$ is calculated such that the pusher 11 starts the pushing motion after expiry of $t_{Offset}$. This is not possible in this particular example because the actual number of cycles $T_E$ would be greater than $T_{MAX}$ and is thus restricted to $T_{MAX}$. This means that time $t_v$ is longer by a control deviation R than the sequences illustrated previously. For a "normal case", as shown in FIGS. 1 to 4, the control deviation R assumes a value of "0". After the light barrier $L_2$ has detected the printed product 3 with number $(n+1)_3$, the actual number of cycles $T_E$ is recalculated such that the pusher 11 can start pushing after expiry of $t_{Offset}$. After machine cycle $Z(_{n+1})$ the value of time t, is once again at the intended value and the cutting device 1 can continue to produce with a constant actual number of cycles $T_E$=$T_N$.

The method, in an embodiment, can be described in simple terms as a synchronisation method for the cutter 12 of a cutting device 1 by prior detection of printed products 3 and regulation of the actual number of cycles of the cutter 12 according to the supplied printed products 3, in which the actual number of cycles $T_E$ of the cutter 12 is increased if the stack 10 to be cut is formed too late and at least one empty cycle is generated. The control device 17 is able to establish whether a printed product 3 is on the first conveying component 26, and precisely where on the component it is, by means of the light barriers $L_1$ and $L_2$ together with the clock generator 22. This enables the first conveying component 26 to be run empty at the original speed or stopped sufficiently quickly so that a printed product 3 is not fed to the stacking device 5 at an excessively low speed in the event of the cutting device 1 and/or the conveying means 2 stopping. If there is still a printed product 3 on the first conveying component 26 after the first conveying component 26 has stopped, the first conveying component 26 is driven backwards until the printed product 3 is detected by the light barrier $L_1$.

After the first conveying component 26 restarts in the feed direction F, the printed product 3 located on the conveying component then has a long acceleration time so that it can be fed (by dropping) to the stacking device 5 at full speed.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below.

What is claimed is:

1. A method for regulating a speed of a cutting device comprising a cutter for cutting printed products, the method comprising:

transporting the printed products consecutively on a first conveying component of a feed device;

detecting a final printed product of a stack of the printed products to be formed;

forming the stack in a stacking device;

transporting the stack to the cutter using the feed device;

regulating an actual number of cycles of the cutter based on a time of the detecting the final printed product of the stack such that the stack is fed to the cutter within a time window; and inserting at least one empty cycle of the cutter and increasing the actual number of cycles of the cutter based on a late supply of the final printed product, wherein a second conveying component of the feed device is stopped during the at least one empty cycle of the cutter.

2. The method according to claim 1, wherein the stack formed in the stacking device is fed to the second conveying component of the feed device which performs the transporting the stack to the cutter, the time window corresponding to a difference between a longest available time and a shortest available time required to feed the stack to the second conveying component.

3. The method according to claim 2, wherein the second conveying component includes a pusher which performs the transporting the stack to the cutter, and further comprising calculating a minimum and a maximum value from the time window for an offset time such that the stack is transported to the cutter on expiry of the offset time except during the at least one empty machine cycle, wherein the late supply of the final printed product is such that the final printed product does not arrive until after the expiry of the offset time.

4. The method according to claim 1, wherein the regulating the actual number of cycles of the cutter is performed based on an arrival time of the final printed product.

5. The method according to claim 1, wherein the regulating the actual number of cycles of the cutter includes reducing or increasing the actual number of cycles compared with a previous number of cycles.

6. The method according to claim 1, further comprising adjusting a speed of the printed products on the first conveying component of the feed device as a function of a length of the printed products and irrespective of the actual number of cycles of the cutter.

7. The method according to claim 1, further comprising feeding the printed products to the cutting device from a processing machine disposed upstream of the cutting device and presetting, by the processing machine, a nominal number of cycles of the cutter of the cutting device.

* * * * *